US007364464B2

(12) United States Patent
Iino et al.

(10) Patent No.: US 7,364,464 B2
(45) Date of Patent: Apr. 29, 2008

(54) ELECTRICAL DOCKING CONNECTOR

(75) Inventors: Koichi Iino, Yokohama (JP); Guo-Jian Shen, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/647,790

(22) Filed: Dec. 28, 2006

(65) Prior Publication Data

US 2007/0298658 A1 Dec. 27, 2007

(51) Int. Cl.
*H01R 13/648* (2006.01)

(52) U.S. Cl. ..... 439/607; 439/680

(58) Field of Classification Search ..... 439/79, 439/607, 610, 680, 660
See application file for complete search history.

(56) References Cited

U.S. PATENT DOCUMENTS 5,190,464 A * 3/1993 Chow et al. ..... 439/188
5,354,207 A 10/1994 Chikano
5,417,590 A * 5/1995 Dechelette et al. ..... 439/607
5,637,015 A * 6/1997 Tan et al. ..... 439/607
5,660,558 A * 8/1997 Osanai et al. ..... 439/353
5,683,269 A * 11/1997 Davis et al. ..... 439/607
5,755,595 A * 5/1998 Davis et al. ..... 439/607
5,797,770 A * 8/1998 Davis et al. ..... 439/607
5,876,222 A * 3/1999 Gardner et al. ..... 439/79
6,036,544 A * 3/2000 Brunker et al. ..... 439/607
6,039,606 A * 3/2000 Chiou ..... 439/610
6,257,914 B1 * 7/2001 Comerci et al. ..... 439/357
6,280,209 B1 * 8/2001 Bassler et al. ..... 439/101
6,319,063 B1 * 11/2001 Huang ..... 439/610
6,347,961 B2 * 2/2002 Zhu et al. ..... 439/607
6,458,001 B1 * 10/2002 Chen et al. ..... 439/680
6,527,564 B1 * 3/2003 Yeh ..... 439/76.1
6,595,801 B1 * 7/2003 Leonard et al. ..... 439/607
6,685,486 B1 * 2/2004 Zhang et al. ..... 439/79
6,705,894 B1 * 3/2004 Comerci et al. ..... 439/607
6,764,339 B2 * 7/2004 Kubo ..... 439/607
6,814,614 B2 * 11/2004 Kuroki et al. ..... 439/579
6,870,750 B2 * 3/2005 Siek ..... 365/63
6,953,361 B2 * 10/2005 Li et al. ..... 439/358
D512,688 S * 12/2005 Li ..... D13/147
7,094,092 B2 * 8/2006 Yang ..... 439/495
7,108,520 B1 * 9/2006 Delaney et al. ..... 439/79
7,121,887 B2 * 10/2006 Zhang et al. ..... 439/607
7,140,917 B1 * 11/2006 O'Halloran et al. ..... 439/607
2003/0199197 A1 * 10/2003 Yu et al. ..... 439/607
2004/0043659 A1 * 3/2004 Lai ..... 439/607
2007/0243764 A1 * 10/2007 Liu et al. ..... 439/607

FOREIGN PATENT DOCUMENTS

CN 2368187 3/2000
CN 2582216 10/2003

* cited by examiner

*Primary Examiner*—I Briggitte Hammond
*Assistant Examiner*—Larisa Tsukerman
(74) *Attorney, Agent, or Firm*—Wei Te Chung

(57) ABSTRACT

An electrical connector for engaging with a mating connector comprising an insulative housing, a plurality of contacts in the housing and a metallic shell covering the insulative housing. The metallic shell comprises a frame with at least one tab arranged at the front edge of the frame, so as to properly guide the mating connector to prevent contact misalignment or short-circuit during the mating process. The insulative housing comprises a base portion defining a pair of concavities so as to minimize size. A spacer is mounted at a rear end of the housing to prevent the contacts from moving rearward during mating.

12 Claims, 14 Drawing Sheets

ELECTRICAL DOCKING CONNECTOR

CROSS-REFERENCE TO RELATED APPLICATIONS

This application claims priority from the filing of China application Nos. 200620074434.7, 200620074433.2 and 200620074432.8, filed on Jun. 23, 2006.

BACKGROUND OF THE INVENTION

The field of endeavor of this electrical docking connector is, generally, Class 439, Sub-class 65, relating to an electrical connector to conduct electricity from panel circuit to another panel circuit. The invention relates to properly guiding and mating of the contacts of electrical connectors The materials set forth in connection with this U.S. patent application describe an electrical docking connector. Further description of this invention is set forth below and in the attached drawings, (FIGS. 1-13).

BRIEF SUMMARY OF THE INVENTION

The present invention relates to an electrical connector, and more particularly, to an electrical connector with guiding tab to properly guide the connector during mating to prevent any misalignment and/or short circuit of the contacts, the electrical connector having improved configuration of its insulative housing and having an insulative blocking member to prevent contact terminals from moving backward during mating with a complementary connector.

DETAILED DESCRIPTION OF THE INVENTION

Figure 1:
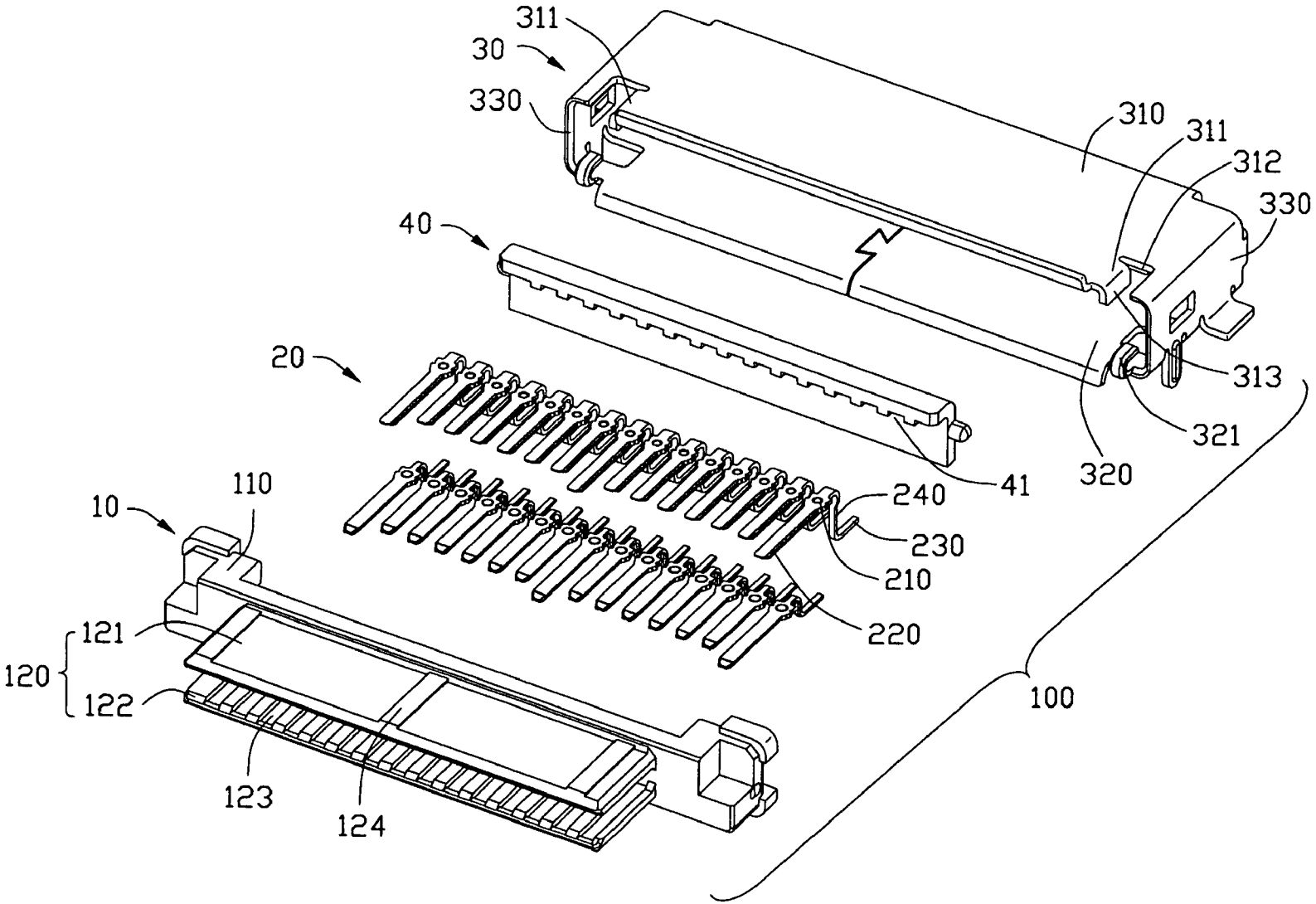
FIG. 1 is an exploded view of the connector in accordance with the present invention.

U.S. Design Pat. No. D488,446 discloses an electrical connector, comprising an insulative housing with a plurality of contact terminals assembled therein, and a metal shield shielding over the insulative housing. The insulative housing disclosed includes an elongate base portion with a tongue extending forward. The contact terminals are positioned on the insulative housing and include a retaining portion secured to the housing, and a contact engaging portion extending from the retaining portion, and a solder tail portion extending out of the insulative housing. The shield provides a tab extending into the housing from a top wall thereof. The tab serves a guiding device such that a guiding slot from a mating connector will ride along the tab so as to ensure a smooth mating.

However, the tab is formed by punching out a C-slot, and then the tab is bent downward so as to extend into the housing. The mating connector is then defined with a guiding slot corresponding to the tab such that the mating connector can be correctly mated with the connector. However, since a front end of the tongue is relatively far from a front edge of the shield, as a result, the mating connector might enter the housing at a slanted angle. It is then likely that a single contact from the mating connector engages with two adjacent contacts, thereby shorting those two adjacent contacts.

In addition, as can be seen from the left and right elevational view, the contact is provided with a vertical portion between the retaining section and the solder tail portion, and which is located on the rear end portion of the housing. Since there is no another protection on the rear portion of the housing to protect the vertical portion, the vertical portion can be easily damaged by accident. Once the vertical portion is damaged and deformed, the coplanarity of the solder tails will be altered, thereby creating the so-called "cold-weld" on the solder tail portion. Moreover, then the mating connector is inserted into the housing, the contact could be pushed such that portion of the contact will be moved backward and driven out of the housing.

U.S. Pat. No. 6,814,614 discloses an electrical connector, including an insulative housing with a plurality of contacts assembled therein. A metal shield is attached to the housing. The insulative housing includes a base portion and a mating portion extending forward from the base portion. The mating portion is defined with a receiving space. The contact includes a contact engaging portion which extends into the receiving space, and a solder tail portion extends backward out of the housing.

Since the contact terminals are arranged in a row, and extend into the receiving space, as the overall length of the connector is limited, the pitch between two adjacent contacts is inevitably quite small accordingly. As such, it is very much likely that a cross-talk electrical interference between two adjacent contacts will be experienced thereby deteriorating the quality of signals. Furthermore, as the metal shield is hung over the insulative housing, it is unlikely to make the mating portion slimmer, which is not beneficial to the miniaturization of the electrical connector.

As a result, it is necessary to provide an improved connector so as to improve the defects encountered by the prior art.

It is an object of the present invention to provide an electrical connector in which misalignment during mating between two connectors can be properly eliminated.

In order to achieve the object set forth, an electrical connector made in accordance with the present invention includes an insulative housing with a plurality of contact terminals assembled therein. The housing is further provided with a metal shield surrounding the housing. The metal shield defines a mating port extending substantially over a frond end of the housing so as to define a lead-in portion. The lead-in portion is formed with a guiding tab extending downward into the mating port. The guiding tab extends from an edge of the mating port of the metal shield.

As compared to the prior art, the electrical connector made according to the present invention features the following advantages. Since the guiding tabs are arranged on the front edge of the mating port of the metal shield, when the connector is mated with a mating connector, both connectors are well and correctly guided so as to secure a proper mating therebetween, while preventing any misalignment between the connectors.

It is a further objective of the present invention to provide an electrical connector in which the contacts are well protected from moving backward during mating with a mating connector.

In order to achieve the objective set forth, an electrical connector in accordance with the present invention comprises an insulative housing having a base portion and a mating portion. The base portion has a front end having the mating portion extends forward therefrom. The connector further includes a plurality of contacts, including a retaining portion secured in the housing, a contact engaging portion extending from the retaining portion, and a solder tail portion connected to the retaining portion by means of a connecting portion. A shield is attached to the housing. The housing is provided with a stopper at a rear portion of the housing such that the contacts are prevented from moving backward.

As compared with the prior art, the connector in accordance with the present invention is beneficial from the following aspect, the backward movement of the contact is limited by the contacts, the contacts can be prevented from being detached from the housing.

It is a further object of the present invention to provide an electrical connector which is most beneficially miniaturized.

In order to achieve this objective, an electrical connector made in accordance with the present invention provides an insulative housing having a mating portion. The mating portion has being defined with upper and lower surfaces, as well as front and rear end surfaces. A plurality of contacts are assembled into the housing. A metal shield is assembled to the housing such that the upper and lower surfaces are properly covered. The mating portion is defined with recessed portion with a bottom thereof. A front portion of the recessed portion is provided with opening. A passage is well defined between a wall of the metal shield and the bottom of the recessed portion such that the contact can be inserted into the passage defined therebetween.

As compared to the existing skill in making the connector, the present invention can be concluded with at least the following advantages, including but not limited, such as at least a passage is defined between the wall of the metal shield and the bottom of the recessed portion of the insulative housing. Since the insulative housing is carved out in the area adjacent to the metal shield, the mating portion of the insulative housing can be made even slimmer. As a result, the overall thickness of the connector can be made even lower making it suitable for compact electronic devices.

Referring to FIG. 1, an electrical connector 100 in accordance with the present invention comprises an insulative housing 10 with a plurality of contacts 20 assembled therein. A metal shield 30 is assembled to the housing 10, and a stopper 40 is provided at a rear portion of the housing 10.

The insulative housing 10 includes a base portion 110 and a mating portion 120. The base portion 110 has a front end portion and a rear end portion. The mating portion 120 extends from the frond end of the base portion 110. The mating portion or tongue portion 120 includes a tongue 120 having an upper tongue portion 121 and a lower tongue portion 122 which is in parallel to the upper tongue portion 121. For description purpose, an upper surface of the upper tongue portion 121 is referred to as upper surface, while a lower surface of the lower tongue 122 is referred to as an external surface, while a lower surface of the upper tongue 121 and an upper surface of the lower tongue 122 are both referred to as internal surface. The inner surfaces of both the upper tongue 121 and the lower tongue 122 are face-to-face, while the upper surface of the tongue 121 and the lower surface of the tongue 122 are back-to-face. The inner surfaces of both the upper and lower tongue portions 121, 122 are defined with passageways 123 arranged offset and alternatively, see FIG. 5 for details. The external surfaces are provided with ribs 124 so as to prevent the upper and lower tongue portions from warping thereby ensuring pre-determined coplanarity of the tongue portions 121 and 122. Accordingly, the electrical reliability when mating with mating connector is thereby ensured. The plurality of contacts 20 are formed with retaining portion 210 secured on the base portion 110 of the housing 10. Each contact 20 further includes a contact engaging portion 220 extending forward from the retaining portion 210 along the corresponding passageway 123. The contact 20 also includes a solder tail portion 230 which is interconnected to the retaining portion 210 by means of a vertical connection portion (not labeled). A block 125 is formed on a front end portion of the passageway 123, see FIG. 6, and which is located in front of a tip portion of the contact engaging portion n220 of the contact 20 thereby protecting the contact 20 from being damaged during the mating.

Figure 2:
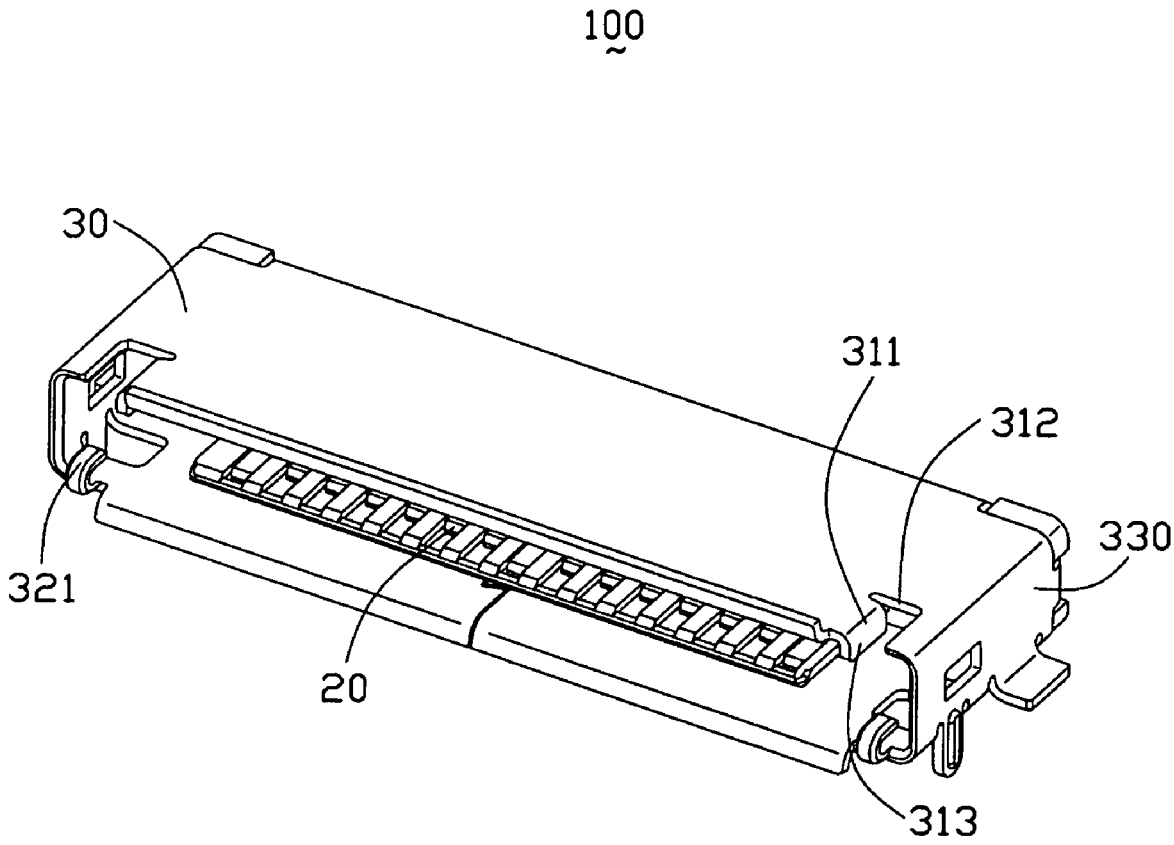
FIG. 2 is an assembled view of the connector shown in FIG. 1.
Figure 3:
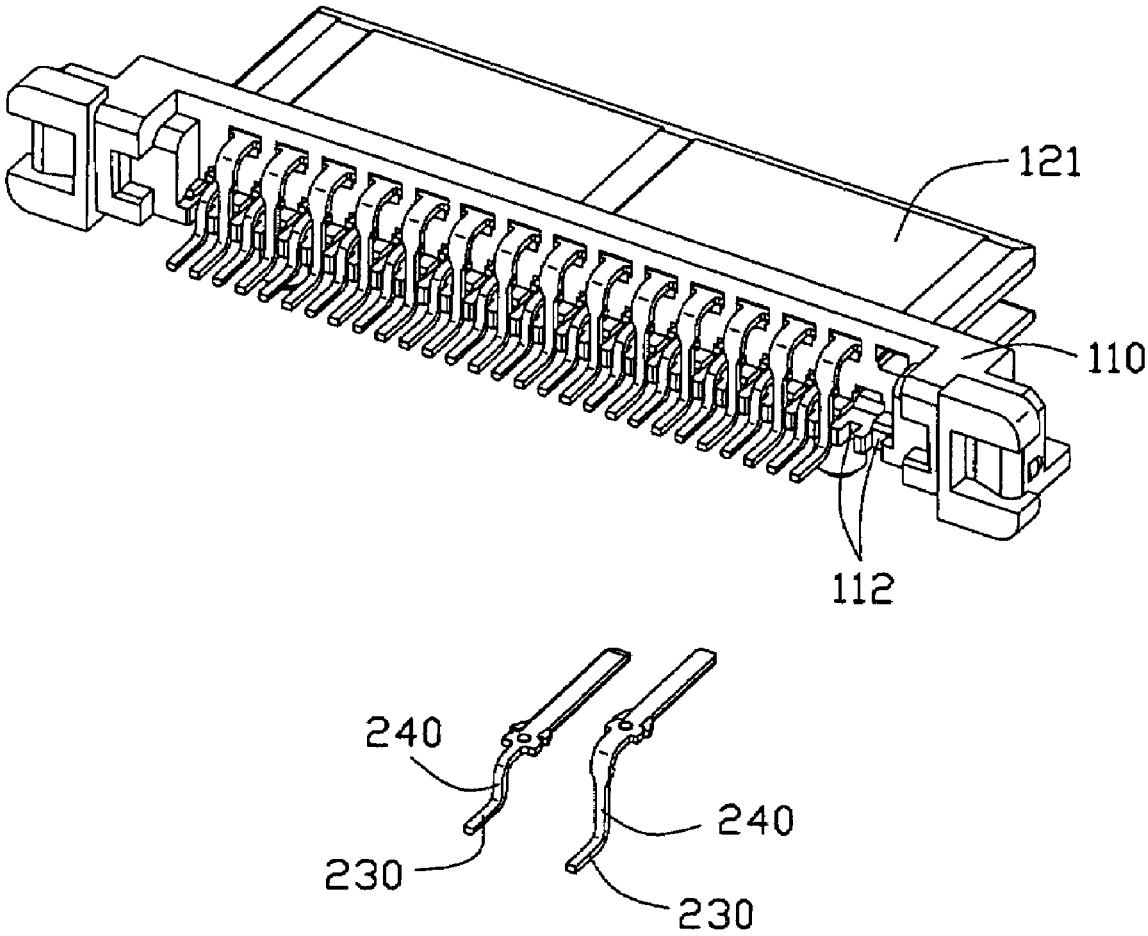
FIG. 3 is an rear view of the contacts assembled in the housing shown in FIG. 1.
Figure 7:
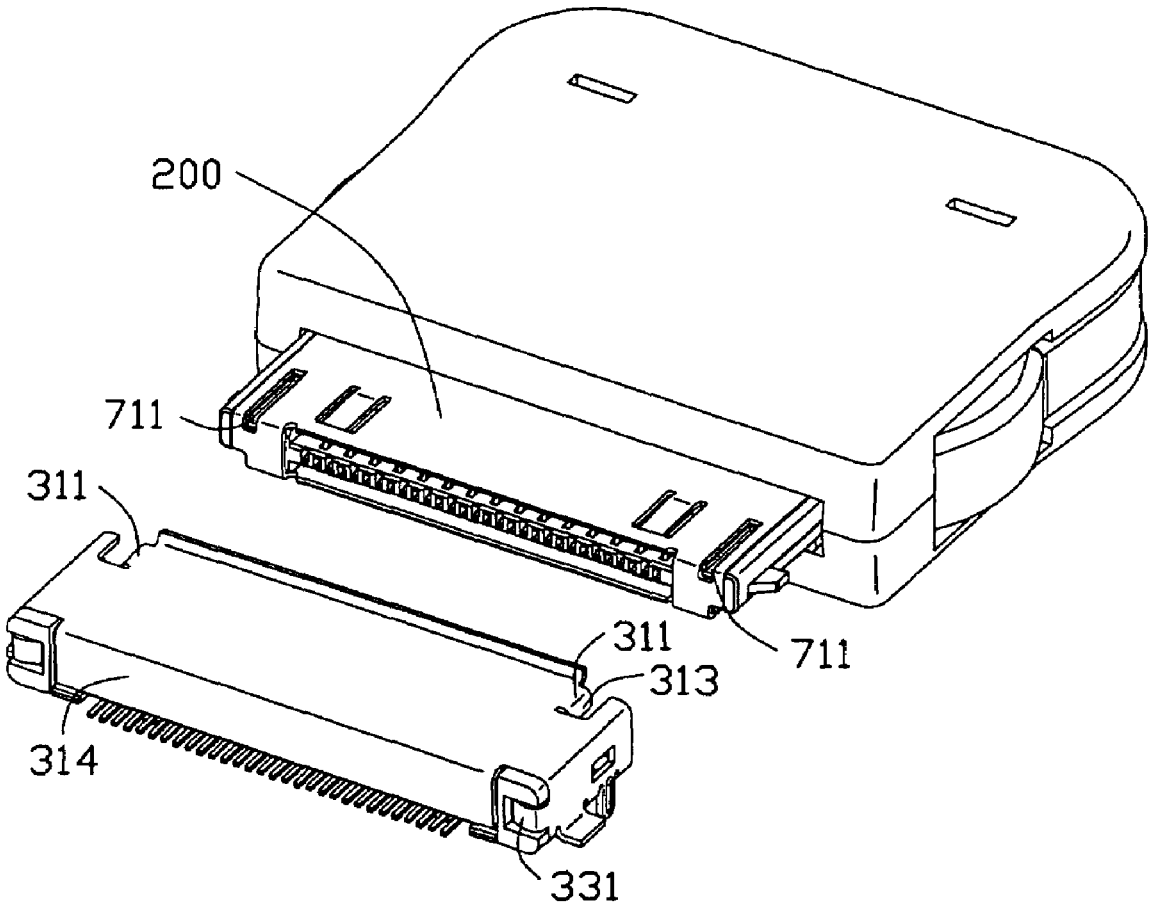
FIG. 7 is an illustration showing the connector made according to the present invention mating with a mating connector.

Referring to FIGS. 1 and 2, the shield 30 includes an upper wall 310 and lower wall 320 and sidewalls 330 interconnecting the upper and lower walls 310, 320 thereby forming a frame encapsulating the housing 10. A mating port (front portion) of the upper wall 310 of the shield 30 is provided with a cutout portion 311 formed by punching out a ـحـ slot 312, which is split from a front edge of the upper wall 310. The cutout portion 311 is later bent downward for forming a tab 313. The slot 312 can be also arranged into other shape. The tab 313 is generally perpendicular to the upper wall 310 and serving as a guiding device incorporating with a guiding slot 711 of a mated connector 200 (see FIG. 7), thereby for providing a robust guiding arrangement when both connectors are mated. Detailed description will be given herebelow. An anti-disorientation arrangement 321 is arranged on a front end of the lower wall 320.

Figure 4:
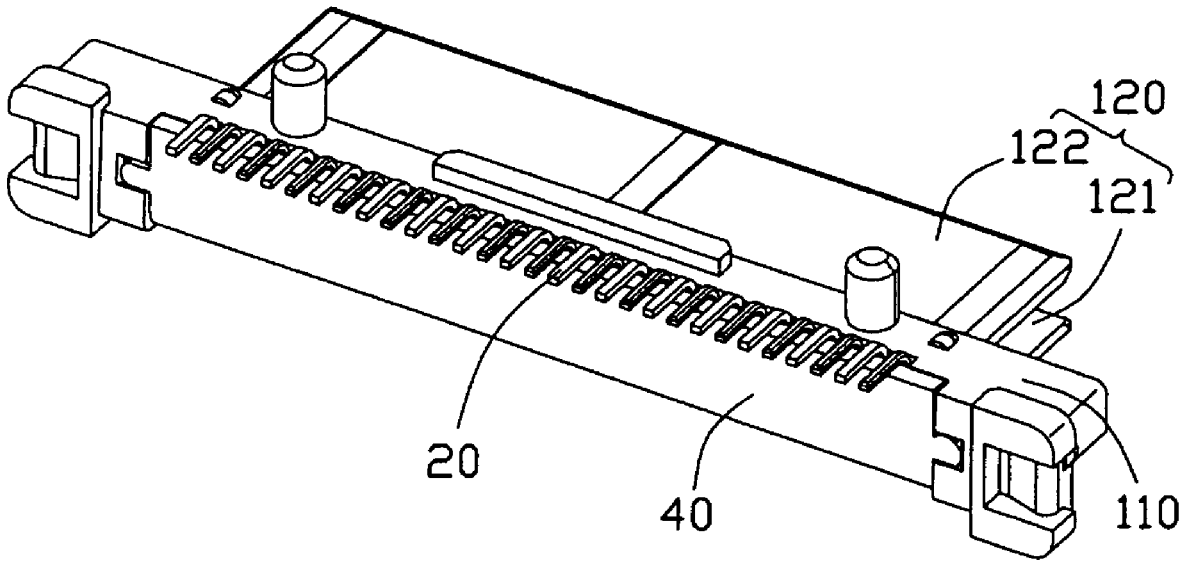
FIG. 4 is a rear view of the connector with the metal shield removed.
Figure 5:
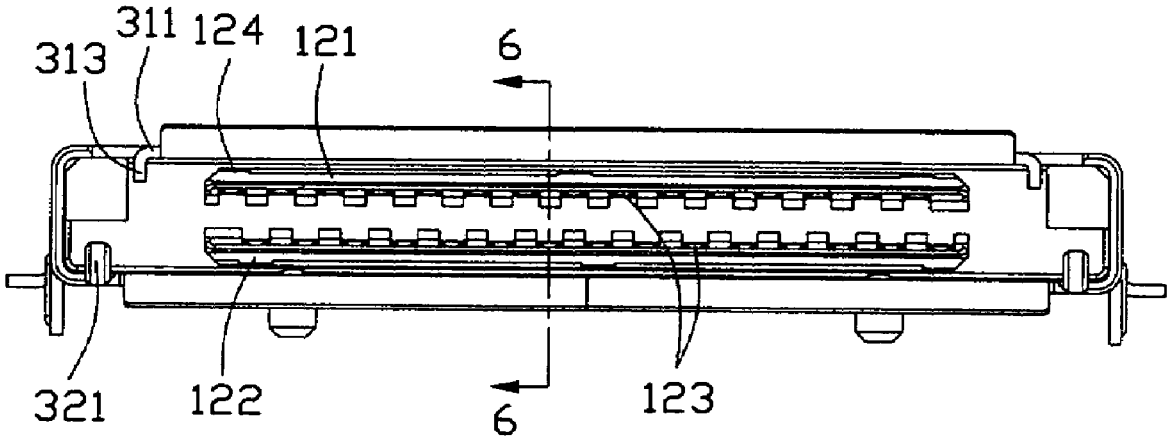
FIG. 5 is a front view of the connector shown in FIG. 2.
Figure 6:
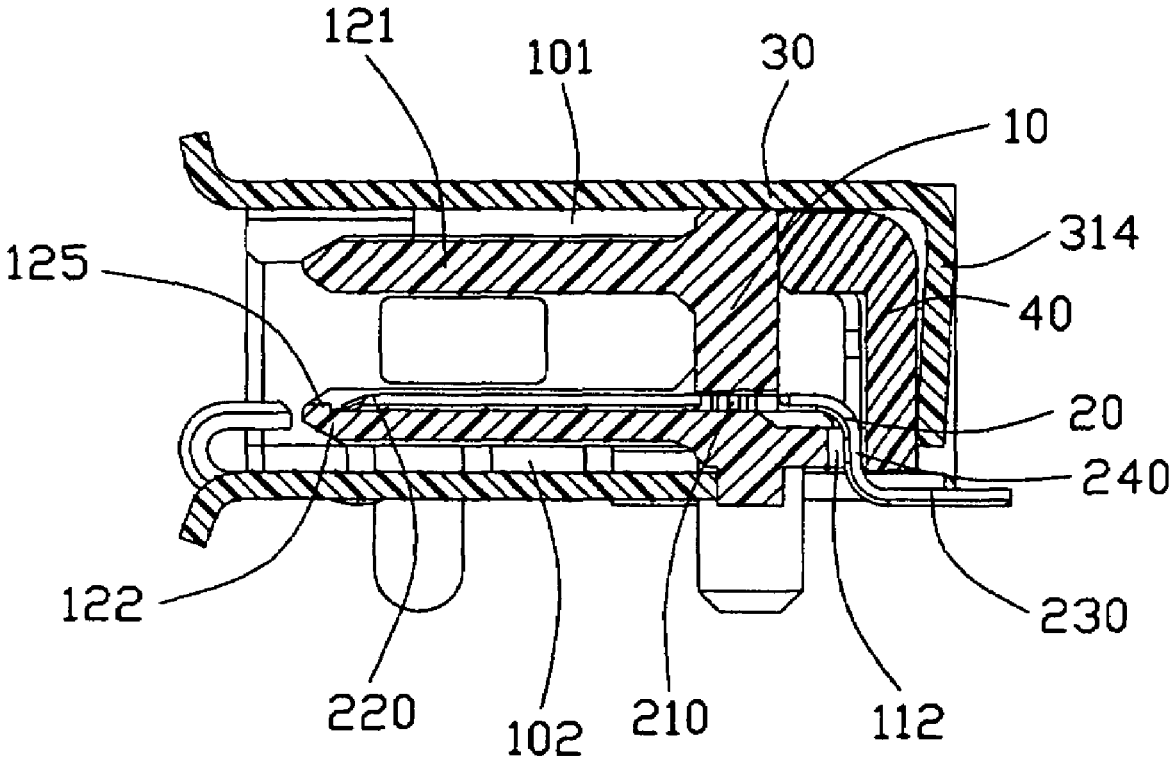
FIG. 6 is a cross sectional view taken from line 6-6 of FIG. 5.

Referring to FIGS. 1 and 5, the contacts 20 are arranged into two groups each received in a corresponding passageways 123 which are arranged alternatively and offset from each other. The contacts 20 are each inserted from rear portion of the housing 10. The stopper 40 is arranged and attached at the rear portion of the housing 10 and adjacent the vertical connection of the contact 20 so as to protect the contacts 20, see FIG. 4. The stopper 40 is provided with a plurality of openings 41 in which a rear end of the retention portion of the contact 20 secured in the upper tongue portion 121 can be securely retained within the opening 41 thereby further positioning the contact 20. The shield 30 is assembled to the housing 10 to the housing 10 along a mating direction. A rear flap portion 314 of the upper wall 310 of the shield 30 is then bent down right immediate to the stopper 40 to further secure the stopper 40 from detached from the housing 10. The end walls 330 of the shield are provided with lock 331 such that the shield 30 is securely attached to the housing 10, see FIG. 6 for details. Referring also to FIG. 6, a first receiving space 101 is defined between the upper shielding portion 310 and the upper surface of the upper tongue 121, while a second receiving space 102 is defined between the lower shielding portion 320 and the lower surface of the lower tongue 122. The first and second receiving spaces 101 and 102 are used to receive the sidewall of the mating connector 200.

Referring to FIG. 2, the metal shield 30 is provided with a cutout portion 311 which is later bent to form the guiding tab 313 which is parallel to the sidewall 330. The guiding tab 313 works with the guiding slot 711 of the mating connector 200, see FIG. 7 for details, thereby correctly guiding the interconnection between those two connectors. As those two connectors are correctly guided and aligned, a short-circuit between two adjacent contacts in the connectors is effectively eliminated.

Referring to FIG. 6, a receiving space 101 is defined between the upper wall 310 of the shield 30, and the upper surface of the upper tongue 121. In addition, the lower wall 320 and the external surface of the lower tongue 122 is also defined with a receiving space 102 for receiving a sidewall of a shield of a mating connector 200.

The stopper 40 in accordance with the present invention is located immediately behind the contacts 20, and is securely attached to the housing 10, accordingly, backward movement of the contact 20 when mated with the connector 20 is advantageously avoided. In addition, a push-down located at the flap portion 314 of the shield 30 is right abut against to the stopper 40 preventing the stopper 40 from detaching from the housing 10. In addition, the flap portion 314 covers substantially the rear portion of the housing 10, therefore further shielding the contacts 20 especially the connection portions of the contacts especially the connection portions of the contacts preventing from EMI, and the stopper 40 blocks the connection portions 240 and the rear portion 314 so as to prevent the rear portion 314 of the shield from contacting the connection portions 240 such that the short circuit is avoid.

The above described is merely a preferred embodiment, while the present invention can be implemented through other preferred forms.

Alternatively, the push-down can be directly formed from the rear portion of the shield 30 and located only behind the stopper 40. In this case, the push-down 315 prevents only the stopper 40 detaching from the housing 10, while will not shield the contacts 20. Alternatively, the push-down can directly press down to the stopper 40 preventing the stopper 40 from detaching. Further, alternatively, the vertical connection of the contact 20 can be set to have a pre-determined angle with respect to the solder tail portion. In this case, the vertical connection is merely a connection, while is not vertical with respect to the solder tail.

Figure 8:
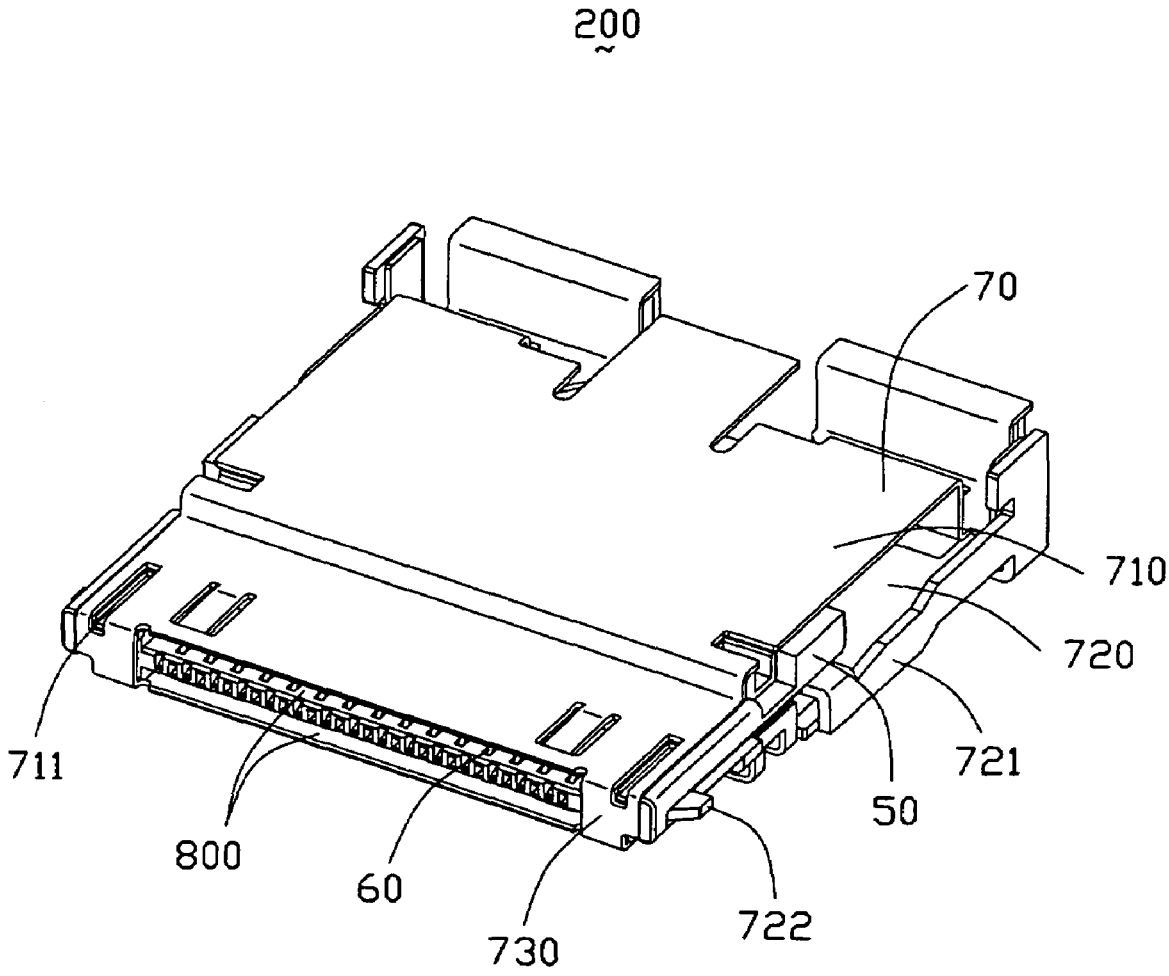
FIG. 8 is a perspective assembled view of an electrical connector made in accordance with the present invention.

Referring to FIG. 8, an electrical connector made in accordance with the present invention includes an insulative housing 50 with a plurality of contact terminals 60 assembled therein. The connector further includes a metal shield 30 assembled to the outer surface of the housing 50.

Figure 9:
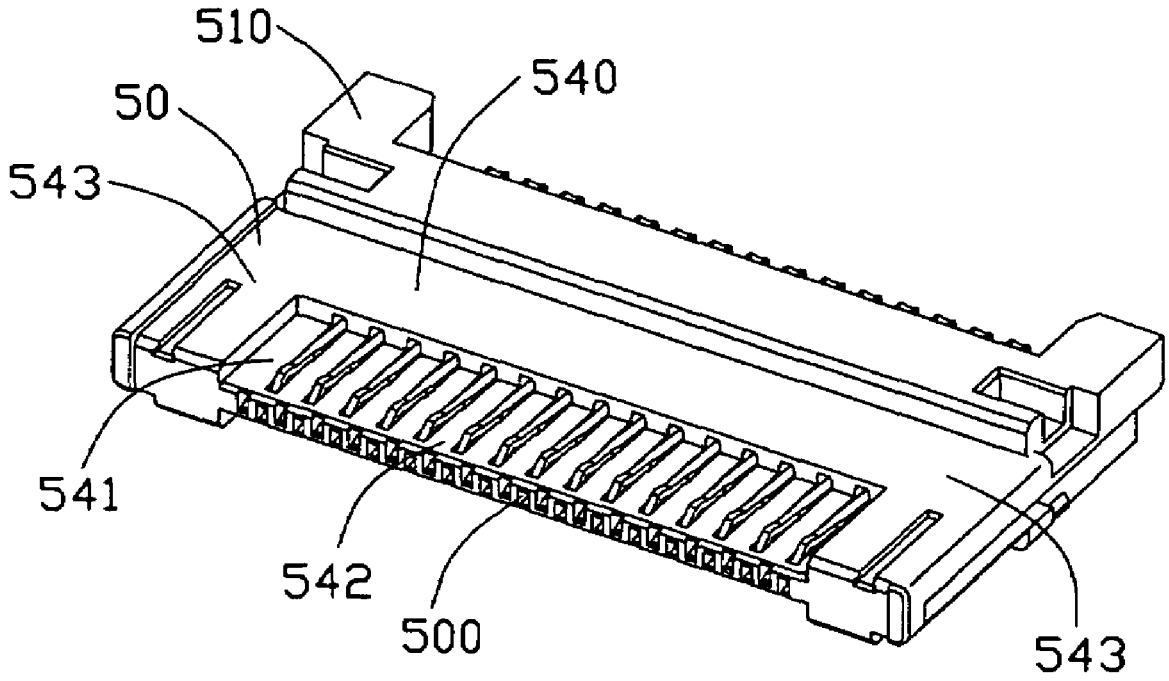
FIG. 9 is an assembled view as FIG. 8 with a metal shield thereof removed.
Figure 10:
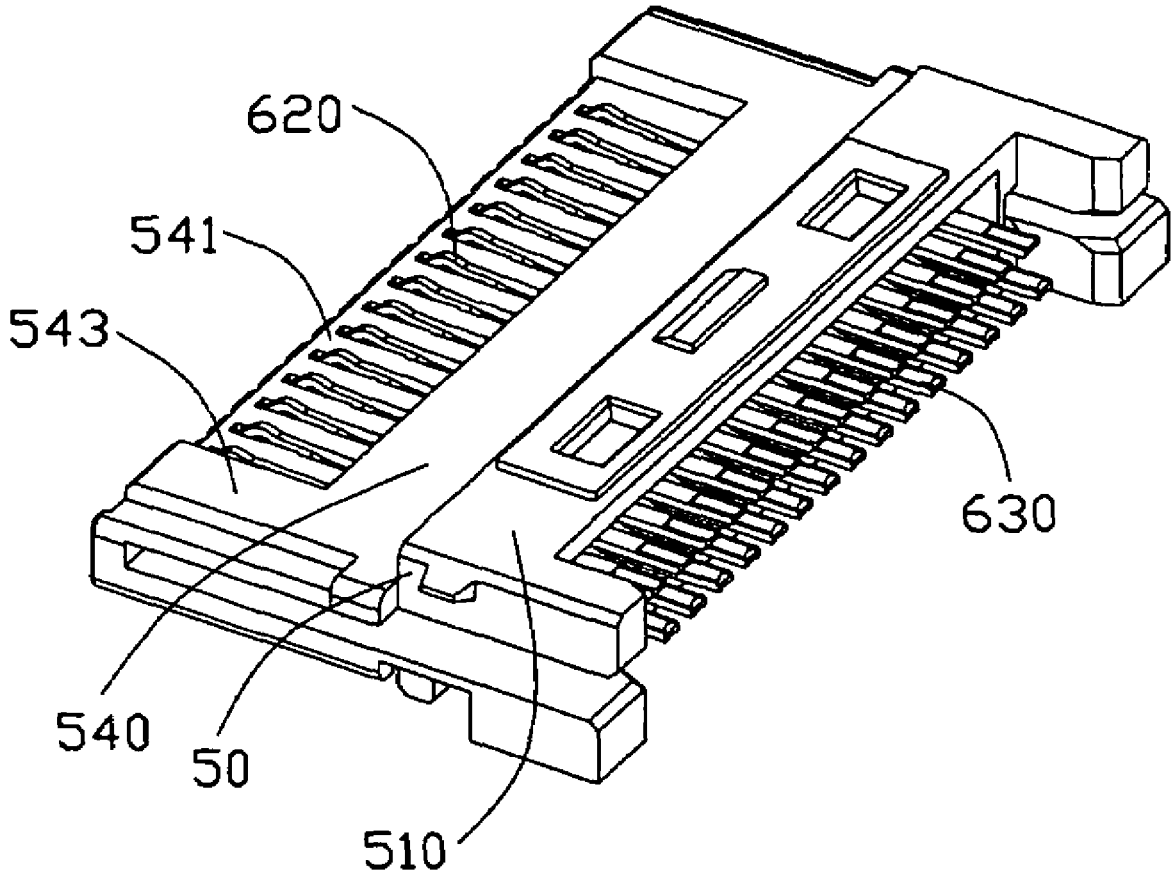
FIG. 10 shows a different view taken from a different angle other than FIG. 9.

Referring to FIG. 9, the insulative housing 50 includes an elongate base portion 510 with a mating portion 540 extending from the base portion 510. The mating portion 540 has upper and lower surfaces (not labeled), as well as front and rear end surfaces. Both the upper and lower surfaces are defined with recesses portion 541 extending through the front end surface so as to define an opening for insertion. A mating tongue 542 is therefore defined between the upper and lower recessed portion 541. The rest of the mating tongue 542, especially adjacent sides of the recessed portion 541 is reinforced so as to form a platform 543 therefore securing the rigidity of the mating tongue 542. By this arrangement, the bottom of the recessed portion 541 is also the top and bottom surfaces of the mating tongue 542. The housing 50 further defines a plurality of passageways 530 arranged alternatively, and which extends from the base portion to the upper and lower surfaces of the mating tongue 542. Detailed description will be given herebelow.

Figure 11:
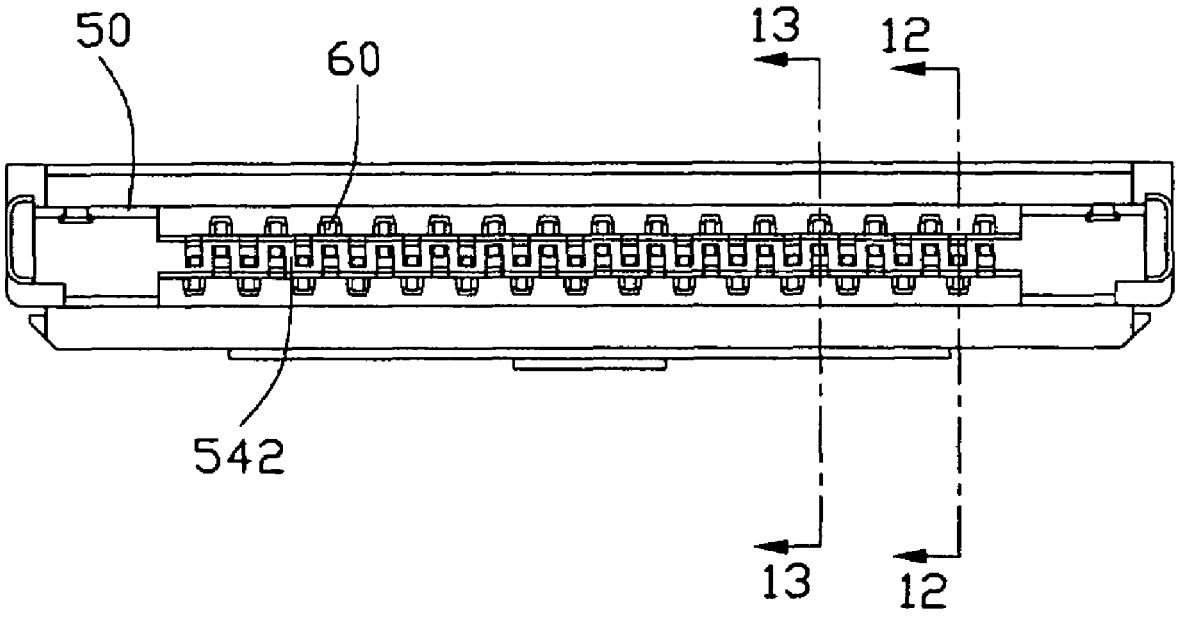
FIG. 11 is a front elevation view of FIG. 9.
Figure 12:
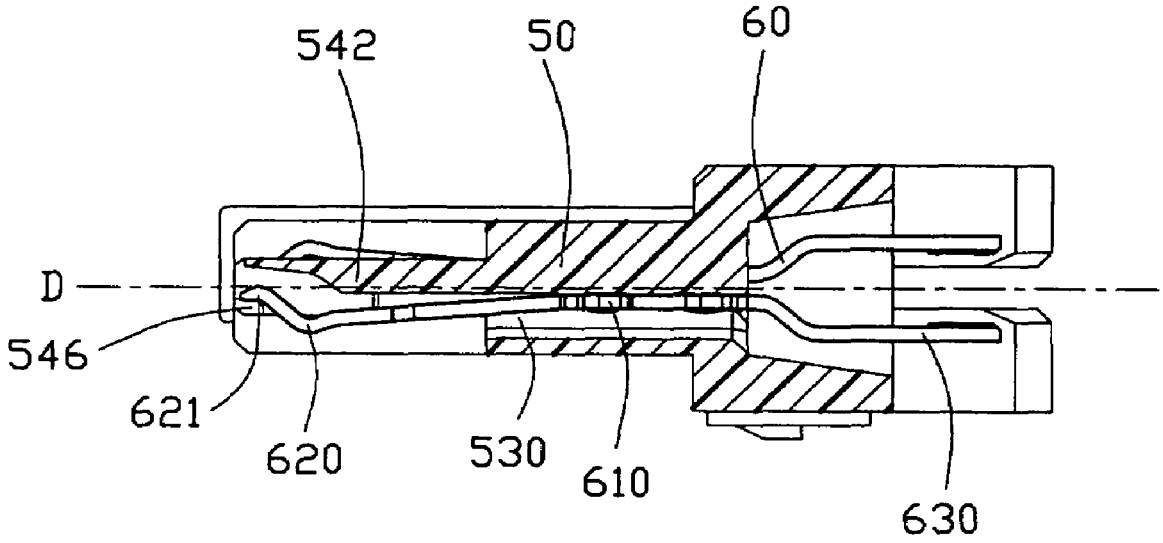
FIG. 12 is a cross-sectional view taken from line 12-12 of FIG. 11.
Figure 13:
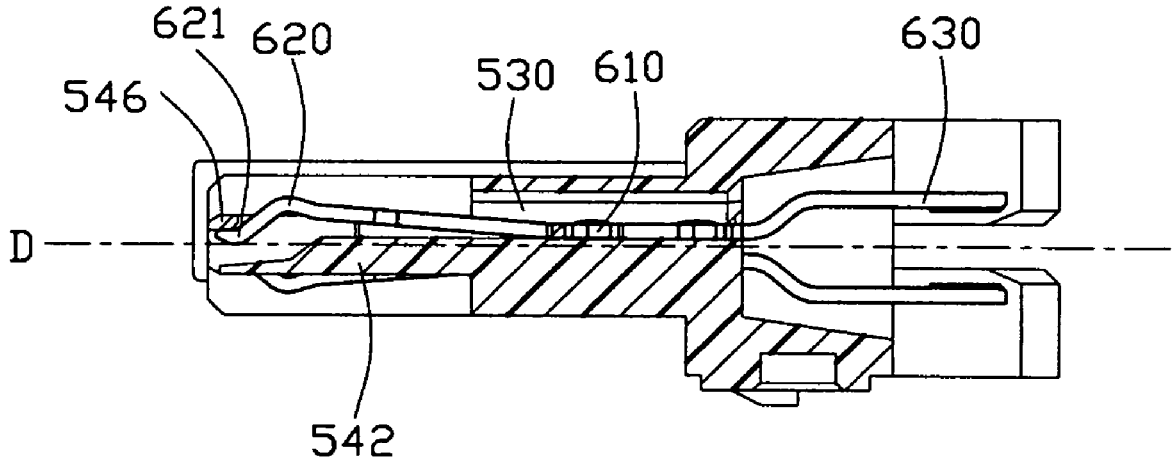
FIG. 13 is a cross sectional view taken from line 12-12 of FIG. 11.

Referring now to FIGS. 11 to 13, the contact terminals 60 are elastic contacts each received in the corresponding passageway 530. Each contact terminal 60 includes a retaining portion 610 securing the contact in the housing 50, and a contact engaging portion 620 extending forwardly from the retaining portion 610, and a solder tail portion 630 extending rearward out of the housing 50. The contact engaging portion 620 is directly formed from stamping a metal sheet, therefore keeping its original flexibility as well as mating capability. From a horizontal direction, the mating tongue 542 is defined with a central plane D. The passageway 530 for the contact engaging portion 620 is defined on the other side of the central plane D. This will not interfere with the passageway 530 which extends through the upper and lower surfaces, see FIG. 11, thereby increasing a room for the deflection of the contact engaging portion 620 during mating and unmating. As a result, the thickness of the housing 50 can be made even thinner and thinner. The solder tail portions 630 are arranged in upper and lower arrangement so as to form a "straddle" to receive a printed circuit board (not shown in Figure) therein. On the other hand, the contact engaging portion 620 is provided with an abutting portion 621 which presses against a block 546 formed on the front portion of the passageway 530. This will further prevent the contact 60 from moving forward, and therefore securing it with respect to the passageway.

Figure 14:
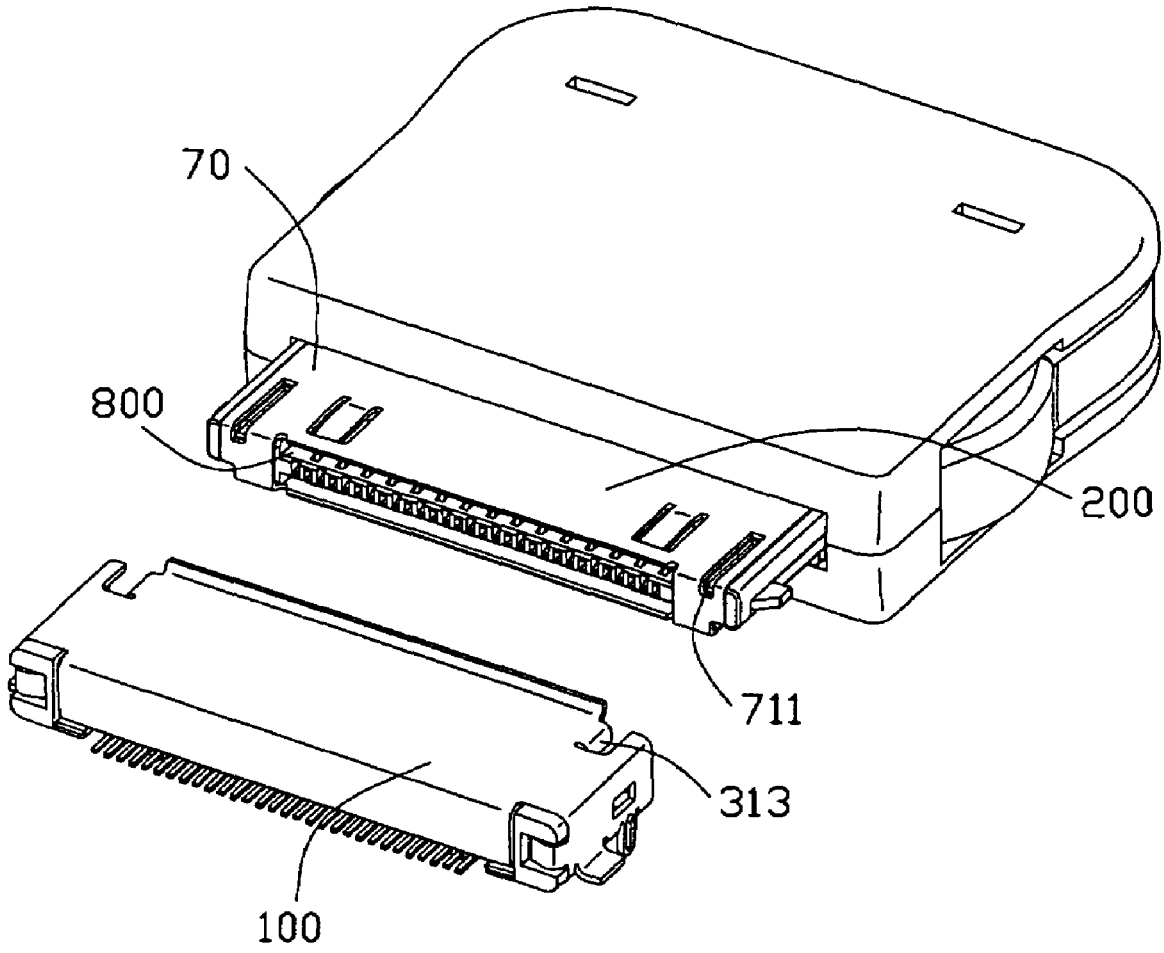
FIG. 14 is an illustration showing the connector made in according with the present invention mating with a mating connector.

Referring to FIGS. 8 and 9, the metal shield 70 is directly formed by stamping a metal sheet, and includes a first shielding portion 710, a second shielding portion 720, and a connection 730 interconnecting the first and second shielding portions 710 and 720. The first and second shielding portions 710 and 720 each abut onto the upper and lower surfaces of the mating portion 540. In the preferred embodiment of the present invention, the first and second shielding portions 710 and 720 are smoothly covering the upper and lower surfaces of the mating portion 540, while the connection 730 is arranged on both sides of the front end portion of the mating portion 540. The thickness of the platform 543 is equal to the mating portion 540, accordingly, the first and second shielding portions 710 and 720 cover the platform 543. The first shielding portion 710 is also defined with guiding slot 711 which extends into the platform 543 of the mating portion 540 for receiving the mating connector 200, see FIG. 14 for details. Accordingly, the connectors can be smoothly and correctly engaged. The second shielding portion 720 is provided with locking arm 721 bent upwardly. A latch 722 is formed on the front of the locking arm 721 so as to securely interlock the connectors after mating.

The upper and lower surfaces of the mating portion 540 is each defined with the recessed portion 541, and therefore defining the mating tongue 542 between the upper and lower recessed portions 541. A first receiving space 800 is defined between the upper surface of the mating tongue 542 and the first shielding portion 720, while a second receiving space 800 is defined between the lower surface of the mating tongue 542 and the second shielding portion 720. Each of those receiving space 800 is used to receive a mating tongue of a mated connector (not shown). In the existing prior art, both sides of the receiving space 800 is provided with insulative portion, while in the present invention, one end of the receiving space is the insulative housing, while the other side is metal shield 70. By this arrangement, the mating portion 540 of the connector can be made thinner and thinner thereby reducing the thickness of the connector. On the other hand, the passageway 530 behind the contact engaging portion 720 is recessed to the other side centered on the central plane D so as to increase the room for deflection of the contact engaging portion 720. As a result, this arrangement can also be used so as to reduce the thickness of the connector. As a result, the overall thickness of the connector is reduced.

The above described is merely a preferred embodiment of the present invention, and the connector in accordance with the present invention can be embodiment in other form.

Alternatively, both ends of the mating tongue 542 can be discrete with respect to the platform 543 such that the mating tongue 542 is isolated from the platform 543.

What is claimed is:

1. An electrical connector assembly comprising:

an insulative housing;

a plurality of conductive terminals retained in the housing; and a shielding member assembled on the housing, said shielding member comprising a pair of sidewalls opposite to each other and an adjoining portion and forming a mating cavity between the sidewalls to receive a complementary connector;

wherein at least one guiding tab is split from a front edge of the adjoining portion and extends into the mating cavity along a vertical direction essentially perpendicular to a mating direction of the connector, wherein the complementary connector forms at least one channel structure on an exterior face, said channel structure emending rearward from a front edge thereof and adapted to be aligned with and receive the guiding tab therein.

2. The electrical connector assembly of claim 1, wherein the adjoining portion defines with a cutout portion formed by punching out a slot running through the front edge of the adjoining portion and the cutout portion bends toward the mating cavity forming one said guiding tab.

3. The electrical connector assembly of claim 1, wherein the housing comprises a longitudinal base portion and a pair of tongue portions extending forward from the base portion, and each of the pair of tongue portions defines a plurality of channels thereon for accommodating the conductive terminals therein.

4. An electrical connector assembly comprising:

an insulative housing having a mating portion comprising an upper surface and a lower surface;

a plurality of conductive terminals retained in the housing;

a shielding member assembled on the housing;

wherein at least one said surface of the mating portion defines at least one recess extending through a front surface of the mating portion, thereby forming a receiving space between the shielding member and a bottom surface of the recess, and the bottom surface further defines a plurality of channels used for accommodating the conductive terminals therein;

a complementary connector having another housing with another mating portion enclosed in another shielding member;

wherein said another mating portion is inserted into the receiving space, while said another shielding member cooperates with said another mating portion to sandwich said shielding member therebetween.

5. The electrical connector assembly of claim 1, wherein the another mating portion essentially has a equal thickness along a transverse direction while the mating portion essentially has two quite enlarged ends in the transverse direction.

6. The electrical connector assembly of claim 4, wherein the housing comprises two said recesses respectively depressed from the upper and lower surface of the mating portion and a mating tongue formed between the two recesses, and the bottom surfaces of the recesses respectively form upper and lower surfaces of the mating tongue.

7. The electrical connector assembly of claim 6, wherein the channels on the bottom surface of the recess are aligned staggeredly with channels defined on the lower surface of the mating tongue.

8. The electrical connector assembly of claim 4, wherein the shielding member has two main plates respectively for covering the upper and lower surfaces of the mating portion, and a connection portion integrally connecting with the two main plates and covering the front surface of the mating portion without the area which the recesses extend through.

9. The electrical connector assembly of claim 8, wherein the mating tongue integrally connects with lengthwise ends of the mating portion.

10. An electrical connector assembly comprising:

an electrical connector including:

an insulative housing having a mating portion comprising an upper surface and a lower surface;

a plurality of conductive terminals retained in the housing;

a shielding member assembled on the housing;

wherein at least one of said surfaces of the mating portion defines at least one recess extending through a front surface of the mating portion, thereby forming a receiving space between the shielding member and a bottom surface of the recess under a condition that the shielding member is intimately seated upon said one surface of the mating portion, and the bottom surface further defines a plurality of channels used for accommodating the conductive terminals therein; and a complementary connector having another insulative housing with another mating portion, wherein said another mating portion is snugly inserted in the receiving space intimately sandwiched between said mating portion and said shielding member.

11. The electrical connector assembly of claim 10, wherein said complementary connector further includes another shielding member enclosing said another mating portion.

12. The electrical connector assembly of claim 11, wherein said another shielding member also encloses said shielding member when said connector and said complementary connector are mated with each other.

* * * * *